United States Patent [19]

Swanson

[11] 4,051,577

[45] Oct. 4, 1977

[54] FIBER CONDENSER

[75] Inventor: Kenneth P. Swanson, Fort Lauderdale, Fla.

[73] Assignee: Progressive Equipment, Inc., Simpsonville, S.C.

[21] Appl. No.: 662,022

[22] Filed: Feb. 27, 1976

[51] Int. Cl.[2] ..... D01H 5/72
[52] U.S. Cl. ..... 19/291
[58] Field of Search ..... 19/150, 157, 287–292

[56] References Cited

U.S. PATENT DOCUMENTS

| | | | |
|---|---|---|---|
| 1,448,191 | 3/1923 | Butler | 19/150 X |
| 2,430,611 | 11/1947 | Gwaltney et al. | 19/291 X |
| 2,677,857 | 5/1954 | Solanas | 19/290 |
| 2,735,141 | 2/1956 | Tarbox | 19/288 X |

FOREIGN PATENT DOCUMENTS

| | | | |
|---|---|---|---|
| 359,637 | 2/1962 | Switzerland | 19/291 |

*Primary Examiner*—Dorsey Newton
*Attorney, Agent, or Firm*—Bailey, Dority & Flint

[57] ABSTRACT

A fiber condenser is illustrated having a strand guiding and delivery opening for feeding fiber forwardly into a nip formed by a pair of superposed rolls wherein a flange is carried by the condenser and extends rearwardly therefrom for engagement by a bracket carried adjacent the rolls for limiting transverse movement of the condenser in either direction. The bracket may be carried by a transverse bar which also supports a cradle assembly for alignment. Normally, a tendency of the condenser to move laterally in relation to the rolls is limited or restrained by the presence of the fiber strand but when such becomes broken, there is a tendency for the condenser to become dislodged from the nip and fall to the floor of the mill.

5 Claims, 2 Drawing Figures

30
26b
29
26
30
27b
27
26a
33
A
C
B
28
27a
32
31
34
B
15
35
21
22
18
S
17
23
25
30
26
27
A
24
14
25a
16
15
20
27a
C
36
B
19
13
10
12
11

FIBER CONDENSER

BACKGROUND OF THE INVENTION

Transverse or side to side movement of the fiber condenser occurs during a spinning operation, where a strand is delivered from the aprons of a drafting system to the nip of succeeding rolls, as a result of strand movement as it progresses moving from side to side toward the nip. In order to properly function, the fiber condenser must accommodate the irregular movement of the strand during its progression toward the nip. Thus, the condenser also transverses from side to side. It is also a characteristic tendency for the guide to move in and out in relation to the nip. When a strand comes down as during such a spinning operation, there is the tendency because of the action of the rolls forming the nip within which the condenser is positioned, to dislodge the condenser throwing it to the floor of the mill where it may become damaged or lost. Finding and picking the condener up and again properly positioning it and the yarn for resumption of the drafting operation adds to labor cost. There is a further tendency for the condenser to become drawn into the nip so as to become crushed therein. This tendency is aggravated where a substantial portion of the exterior surface of the condenser is positioned within the nip is in frictional contact with the nip forming rolls. Attempts to solve the aforementioned problems are exemplified by the disclosure of U.S. Pat. No. 2,941,261 utilizing a bar to limit rotation of a special condenser. U.S. Pat. Nos. 1,942,121; 2,735,141 and 3,273,206 show the use of laterally extending rods for supporting pairs of condensers.

Accordingly, it is an important object of this invention to provide a condenser wherein means are provided for maintaining the condenser within proper position in the nip so as to avoid dislodgment of the condenser when an end comes down.

Another important object of the invention is to provide a positive means for positioning a condenser within the nip yet accommodating the various movements or undulations in the yarn as it moves towards a pair of nip forming rolls.

Still another important object of the invention is the provision of a fiber condenser which will present a minimum of contact surface with the surface of the rolls forming the nip wherein the fiber condenser is positioned so as to minimize the tendency of frictional contact between the condenser and the surface of the rolls to draw the condenser into the rolls so as to result in damage.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2:
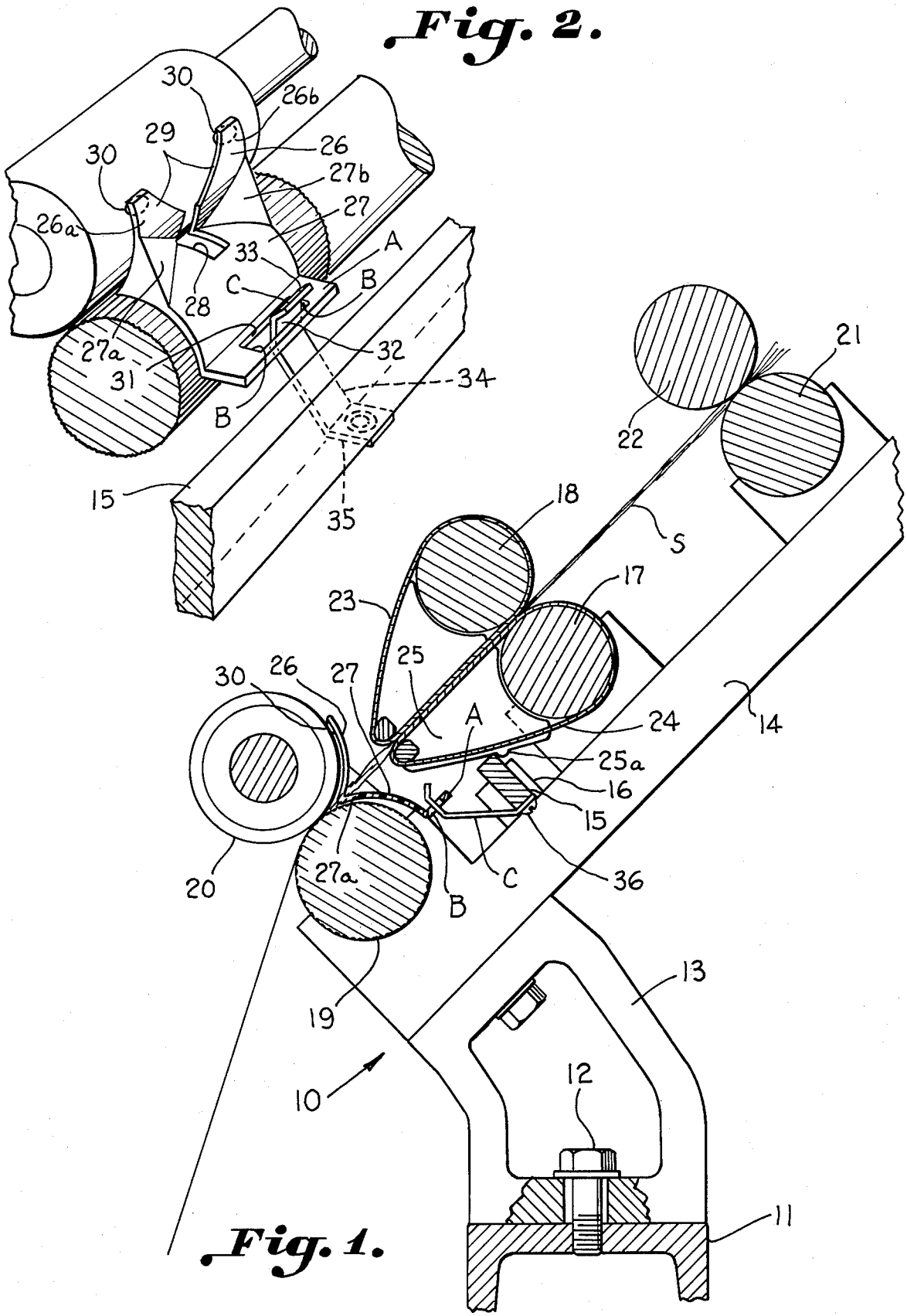
FIG. 1 is a schematic transverse sectional elevation, with parts omitted, illustrating a fiber condenser constructed in accordance with the present invention in restrained position adjacent the nip of a pair of rolls as for receiving a strand from the apron of a drafting system.
FIG. 2 is a perspective view looking from the right hand side in FIG. 1 further illustrating the fiber condenser.

The drawing illustrates a fiber condenser for feeding a fiber strand forwardly into the nip formed by a pair of superposed rolls. A flange A is carried by the fiber condenser extending rearwardly from said nip. Transversely spaced abutment means B are carried by the flange. A bracket C is carried adjacent the rolls having a projection engaging the abutment means for limiting transverse movement of the condenser in either direction. Thus, when the fiber strand comes down the tendency for the condenser to move tansversely out of engagement with the rolls, as is normally restrained by the fiber strand, may be overcome by the limitation in movement of the condenser afforded by the spaced abutment means when engaged by the bracket.

While the invention is described in connection with the delivery of a strand from the apron of a spinning frame to the nip formed by the front bottom roll and front top roll, it is to be understood that such may be advantageously employed in connection with any fiber strand delivery to a pair of nip forming rolls.

The drawings further illustrate a spinning frame drafting system comprising roll stands, broadly designated at 10, secured in logitudinal spaced relation upon the usual beam 11 as by bolt means 12. The roll stands 10 include offset brackets 13 which carry upwardly and rearwardly inclined frame members 14. A bar 15 extends transversely of the inclined frame members 14 longitudinally of the spinning frame between respective spaced roll stands. The transverse bars 15 are suitably secured by bracket means 16 to respective roll stands. The transverse bars 15 are illustrated as being carried adjacent upper surfaces of the roll stands between the bottom and top middle rolls 17 and 18, respectively, and the front bottom roll and front top roll 19 and 20, respectively. FIG. 1 illustrates a strand S of loose fibers passing from the nip of the back bottom roll 21 and the back top roll 22 and through the aprons 23 and 24 which are carried by cradles shown in FIGS. 1 and 2 having sides schematically illustrated as at 25. The cradles are similar to those shown in U.S. Pat. No. 3,872,546, however, it will be noted that the cradle sides 25, illustrated herein, have downwardly extending protuberances **25*a* which limit the movement of the cradles which bear immediately forwardly thereof upon the transverse bars 15**.

The strand then progresses from the aprons toward the nip formed by the front bottom roll 19 and front top roll 20 passing through a condenser for guiding and delivering the strand to the nip of the rolls. The condenser includes upper and lower arcuate converging members 26 and 27 having surfaces conforming generally with and positionable in superposed relation to respective nip forming roll surfaces. The converging members 26 and 27 are bridged by converging sides as illustrated at **27*a*. A strand guiding delivery opening 28 is illustrated as a substantially elongated rectangular slot positioned vertically at the convergence of the surfaces 26 and 27. A substantially V-shaped downwardly converging opening is formed by converging surfaces 29 formed in the upper member 26 for receiving and guiding the strand into the delivery opening 28. It will be noted that the strand receiving opening 29 is open at the top and extends into the strand guiding delivery opening 28 thus dividing the upper member 26 into substantially vertical extensions 26a and 26b. The inner surface of the projections 26a and 26b adjacent the top thereof and facing toward an adjacent roll surface carry spaced inward projections 30**. These spaced inward projections or buttons limit frictional engagement between the fiber condenser and the rolls so as to avoid the drawing in of the condenser between the rolls.

Transversely spaced abutment means B are defined by a slot 31 which extends transversely of the flange A so as to receive a projection 32 of the bracket C. The projection 32 is loosely received within the slot 31 which has transversely spaced inner edges or abutments B which limit side to side oscillation of the fiber condenser. The slot 31 also has spaced sides permitting loose reception of the projection 32 to permit forward and rearward movement of the condenser but which are suitably spaced to limit such movement and to confine the condenser in position within the nip as when an end comes down. The bracket C is illustrated as including an upturned tip portion 33 extending upwardly from the projection 32 so as to tend to prevent dislodgment of the condenser from the bracket. A rearward extension of the bracket 34 extends from the projection 32 to a rearwardly extending flat 35 which has securement as by a bolt 36 to fasten the bracket to the transverse bar 15.

It will be observed that the transverse bar 15 serves the dual function of maintaining the cradles 25 and aprons carried thereby in alignment on the spinning frame and at the same time serves as a suitable mounting means for the bracket which, together with the abutments carried by the condenser, maintain the condenser in proper position upon the associated rolls though an end comes down.

While a preferred embodiment of the invention has been described using specific terms, such description is for illustrative purposes only, and it is to be understood that changes and variations may be made without departing from the spirit or scope of the following claims.

What is claimed is:

1. A fiber condenser for feeding a fiber strand forwardly into the nip formed by a pair of superposed rolls comprising:

upper and lower arcuate coverging members having surfaces conforming generally with and positionable in superposed relation to respective nip forming roll surfaces;

a strand guiding delivery opening defined by said upper and lower members;

a flange connected to said lower arcuate converging member extending rearward therefrom;

transversely spaced abutment means carried by said flange for limiting transverse movement of said condenser in either direction;

said abutment means being defined by a slot; and a bracket carried adjacent the rolls having a free end extending into said slot for limiting transverse movement of said condenser;

whereby upon said fiber strand coming down the tendency for said condenser to move transversely out of engagement with the rolls, as is normally restrained by the fiber strand, may be overcome by the limitation in movement of the condenser afforded by the spaced abutment means.

2. The structure set forth in claim 1 including, a pair of spaced projections carried by said upper arcuate converging member extending into engagement with a surface of an adjacent roll.

3. A fiber condenser assembly for feeding a fiber strand forwardly from the aprons carried by a cradle into the nip formed by a pair of superposed front rolls carried between the roll stands comprising:

a flange carried by said fiber condenser extending rearwardly from said nip;

transversely spaced abutment means carried by said flange;

a transverse bar for aligning said cradle carried between said roll stands; and a bracket carried by said transverse bar having a projection engaging a respective abutment for limiting transverse movement of said condenser in both transverse directions;

whereby said cradle is aligned in sliver guiding relation with said front rolls and upon said fiber strand coming down the tendency for said condenser to move transversely out of engagement with the rolls, as is normally restrained by the fiber strand, may be overcome by the limitation in movement of the condenser afforded by the spaced abutment means when engaged by said bracket.

4. The structure set forth in claim 3, wherein said abutment means are defined by a slot, and wherein a forward portion of said cradle bears downwardly on said bar and said bracket extends upwardly so that said projection extends into said slot for limiting transverse movement of said condenser.

5. In a fiber condenser for feeding a fiber strand forwardly into the nip formed by a pair of superposed rolls, the improvement comprising:

a flange carried by said fiber condenser extending rearwardly from said nip from a lower portion of said condenser;

transversely spaced abutment means carried by said flange; and a fixed bracket carried below the nip and adjacent the rolls having a portion projecting upwardly therefrom in transversely spaced interfitting relation with said abutment means adjacent their free ends permitting limited transverse movement therebetween for permitting limited transverse movement of said condenser in both transverse directions;

whereby upon said fiber strand coming down, the tendency for said condenser to move transversely out of engagement with the rolls, as is normally restrained by the fiber strand, may be overcome by the limitation in movement of the condenser afforded by the spaced abutment means when engaged by said bracket.

* * * * *